United States Patent [19]

Drabouski, Jr.

[11] Patent Number: 4,549,267

[45] Date of Patent: Oct. 22, 1985

[54] MOMENT STABILITY SYSTEM FOR LARGE VESSELS

[76] Inventor: Stephen J. Drabouski, Jr., 6384 S. Eaton Ct., Littleton, Colo. 80123

[21] Appl. No.: 503,185

[22] Filed: Jun. 10, 1983

[51] Int. Cl.[4] ..... G06F 15/20; B63B 43/04

[52] U.S. Cl. ..... 364/463; 114/124; 114/125

[58] Field of Search ..... 364/463; 114/114, 123, 114/124, 125

[56] References Cited

U.S. PATENT DOCUMENTS

| | | | |
|---|---|---|---|
| 2,751,921 | 6/1956 | Baldwin et al. | 364/463 |
| 3,329,808 | 7/1967 | Fisher | 364/463 |
| 3,408,487 | 10/1968 | Wilde | 364/463 |
| 3,441,721 | 4/1969 | Arpas et al. | 364/463 |
| 3,604,386 | 9/1971 | Turci | 114/125 |
| 3,847,348 | 11/1974 | Russ | 114/125 |
| 3,886,886 | 6/1975 | Anders | 114/125 |
| 3,915,109 | 10/1975 | Martin et al. | 114/125 |
| 3,916,809 | 11/1975 | Miyamoto et al. | 114/123 |
| 3,968,353 | 7/1976 | Küller | 114/125 |

*Primary Examiner*—Felix D. Gruber
*Attorney, Agent, or Firm*—James E. Pittenger

[57] ABSTRACT

An improved computerized moment stability system is provided which will rapidly obtain the solution to operational and post damage stability problems which may be present on an oceangoing vessel. The system includes three functional modules plus an initialization data base module. The data base modules stores the basic stability data concerning all watertight compartments and tanks onboard the vessel. An operational stability module is provided for performing the operational calculations to determine the stability parameters which exist under normal conditions. In addition, the operational module can provide reports concerning the day to day inventory of consumables as well as help in properly performing the loading and unloading of the vessel to maintain a safe, stable, condition at all times. A stability assessment module is included which performs the necessary calculations for the determination of post-damage conditions and the stability parameters for the vessel after battle, collision or grounding damage has been sustained. The post-damage stability is compared with the predamage stability in the corrective strategy module whereby either operator corrective strategy or system developed corrective strategy can be established for correcting the questionable stability of the vessel. Various corrective strategy analyses can be hypothetically attempted to determine the best strategy to follow. The data base module can also provide a system backup through the production of a complete compartment and tank stability card file for possible post-damage stability analysis for the vessel under emergency conditions.

26 Claims, 18 Drawing Figures

STABILITY SYSTEM CONFIGURATION

DATA BASE MODULE

OPERATIONAL STABILITY MODULE

STABILITY ASSESSMENT MODULE

CORRECTIVE STRATEGY MODULE

81

| COMPARTMENT OR TANK NUMBER | A-203-L | | | STABILITY DATA CARD | | |
|---|---|---|---|---|---|---|
| COMPARTMENT OR TANK NAME | CREWS BERTHING | | | USS NEVERSAIL (CV) | | |
| PERCENT FLOODED | 10% | 20% | 30% | 90% | 100% | |
| ADDED WEIGHT | 13 | 31 | 49 | 163 | 183 | TONS |
| VERTICAL MOMENT | 164 | 329 | 512 | 1627 | 1829 | FT TONS |
| FREE SURFACE MOMENT | 26667 | 26667 | 26667 | 26667 | 0 | EXPRESSION |
| FREE COMMUNICATION MOMENT | 720000 | 720000 | 720000 | 720000 | 720000 | EXPRESSION |
| INCLINING MOMENT (S) | 422 | 949 | 1552 | 4827 | 5486 | FT TONS |
| TRIM MOMENT (F) | 173 | 321 | 512 | 1628 | 1829 | FT TONS |
| REMARKS | | | | | | |

Fig. 10

RIGHTING MOMENT CURVE CORRECTED FOR LOAD CHANGES
(REQUESTED THROUGH OPERATIONAL STABILITY MODULE)

RIGHTING MOMENT CURVE CORRECTED FOR DAMAGE DATA
(REQUESTED THROUGH STABILITY ASSESSMENT MODULE)

PROJECTED RIGHTING MOMENT CURVE FOR ENTRERED CORRECTED STRATEGY DATA (REQUESTED THROUGH CORRECTED STRATEGY MODULE)

LIST AND TRIM ANALYSIS REPORT CORRECTED FOR LOAD CHANGES (REQUESTED THROUGH OPERATIONAL STABILITY MODULE)

LIST AND TRIM ANALYSIS REPORT FOR POST-DAMAGE CONDITION
(REQUESTED THROUGH STABILITY ASSESSMENT MODULE)

PROJECTED LIST AND TRIM ANALYSIS REPORT FOR CORRECTED STRATEGY
(REQUESTED THROUGH CORRECTIVE STRATEGY MODULE)

ENHANCED CMSS

CORRECTIVE STRATEGY ANALYSIS

POST DAMAGE: IM 8,000(P) TM 58,200(F) GM CHANGE -1.2 MAX GZ CHANGE -1.1

| CMPT/TK | Flood = F<br>Dewater = D | Liquid Ht.<br>Ft | IM<br>(Ft/Tons) | TM<br>(Ft/Tons) | GM CHANGE<br>(FT) | GZ CHANGE<br>(FT) |
|---|---|---|---|---|---|---|
| 4-210-6-V | F100% | 6.5 | 1,800 (S) | 2,200 (A) | +0.6 | +0.5 |
| 2-200-4-V | F100% | 4.0 | 3,200 (S) | 14,500 (A) | +0.2 | +0.4 |
| 3-210-2-V | F 60% | 3.5 | 1,000 (S) | 9,500 (A) | +0.4 | +0.5 |
| | PROJECTED EFFECTS: | | 6,000(S) | 26,200 (A) | 1.2 | 1.4 |

262

Fig. 17

MOMENT STABILITY SYSTEM FOR LARGE VESSELS

FIELD OF THE INVENTION

This invention is directed to a system and method for determining and correcting the stability of a vessel and more particularly to such a system and method for quickly reestablishing stability in response to any damage or injuries sustained by the vessel.

BACKGROUND OF THE INVENTION

Numerous methods have been tried in the past to correlate data and determine the stability of an oceangoing vessel. This problem usually becomes of magnitude when dealing with large ships, namely those having at least one thousand gross ton displacement.

In most cases, due to the comprehensive design calculations and tests that are made during the design and production of these vessels, the moments of stability during normal operation, both in the longitudinal as well as the transverse direction, usually are not of any major concern.

Various design considerations are emphasized when designing a ship depending upon the intended use and the stability characteristics that are normally required of that ship. For example, a battleship in order to provide a stable gun platform must have a stability which prevents a continuous rolling motion and the ability to withstand substantial rotational force which is produced by the recoil upon the firing of its guns. An aircraft carrier, on the other hand because of its height above the waterline, needs to have considerable weight positioned below the waterline to counterbalance and provide the necessary platform stability. This is especially true in the longitudinal direction for the aircraft carrier because of the necessity for aircraft to take off and land as safely as possible.

Commercial cargo ships, especially those which are designed to carry liquid cargo, such as oil tankers, have special design problems due to the fact that the cargo itself provides significant ballast which effects the stability of the vessel. These factors are controlled during the loading operation where it is necessary to determine how the cargo will be loaded, in what sequence, and in what quantities. In order to accomplish and maintain the stability and trim, it may be necessary to add additional ballast to the ship or to strategically control cargo positioning to maintain the necessary stability especially if rough seas are anticipated.

In order to set the stage for the complete description of this invention, it is necessary to fully understand the terminology and laws of physics which are of concern. Although this description is not intended to be a complete explanation, it will provide the necessary background for understanding.

A floating body is acted upon by many forces, not the least of which are the forces of gravity and buoyancy. Stability is a result of these various forces which act upon the hull of the ship. When a ship is tilted or heeled by some disturbing force, it either tends to return to its original upright position or else to overturn. This tendency to rotate one way or the other is referred to as stability. The tendency to produce rotation in the ship is expressed as a moment and therefore stability is actually a moment tending either to restore the ship to its normal position or to overturn the ship.

Although gravitational forces act everywhere upon a ship, it is not necessary to attempt to consider these forces independently. Instead, we regard the total force of gravity on the ship as a single resultant or composite force representing the total weight of the ship which acts vertically downward through the ship's center of gravity (G).

Similarly, the force of buoyancy may be regarded as a single resultant or composite force which acts vertically upward through the center of buoyancy (B) located at the geometric center of the ship's underwater hull. As long as the center of gravity is above the center of buoyancy and both are aligned on a vertical plane through the longitudinal center of the ship or vessel it is said to be stable.

The real problems concerning stability occur when these forces no longer act in the same vertical plane. A vessel of this type can be disturbed from rest by many different influences, i.e. wave action, wind, turning forces created by the rudder, the addition or removal of off-center loads or cargo and the impact and damage caused by a collision or an enemy hit. These influences exert what are called heeling moments which may be temporary or possibly could be constant. A stable vessel does not capsize when subjected to these disturbances because when inclined, it develops a tendency to right itself called a righting moment (RM). A righting moment is actually equal to the righting arm (GZ) times the weight (W) or displacement of the ship. Since the displacement actually remains constant as the ship heels, the stability of the ship may be measured by the righting arm at any given heel angle.

Another factor which is involved with the question of stability is a term called metacenter (M) and the height of the metacenter (GM) above the center of gravity. When a ship is caused to heel, the center of buoyancy will shift either to starboard or port from the vertical axis.

With the ship at a given draft or depth in the water, the metacenter is the point of intersection of two successive lines of action of the force of buoyancy as the ship is heeled through various angles. The location of the metacenter depends upon how the center of buoyancy moves when the ship heels and for a small angle will usually remain on the centerline or plane of the vessel but with a large angle of heel moves either to the port or starboard side of the centerline depending upon the configuration of the hull.

The metacentric height (GM) is an indicator of the stability of the ship. In naval vessels large metacentric height (GM) and large righting arms (GZ) are desirable for resistance to damage. On the other hand, small GM dimensions are sometimes desirable for slow easy roll which makes for more accurate gunfire. As a result the GM for a naval ship is usually the result of direct compromise. With respect to stability, it is obvious that when the center of gravity is below the metacenter, the GM dimension is positive and correcting righting arms and moments develop. On the other hand, however, when the center of gravity is above the metacenter the GM is negative and upsetting or overturning moments develop. Thus, the GM dimension is an indicator of the magnitude of the stability moments and whether stability is positive or negative for the vessel.

The stability curve is a handy tool for determining the theoretical stability of a vessel. It is possible for ship designers by mathematical and graphic means to compute the righting moment of the ship at any angle of heel. The graph is formed by plotting a series of the moments which are calculated for various angles of heel. As is usual the curve indicates that as the ship heels over, it develops righting moments which gradually increase, reach a maximum and then diminish. At the same time, the stability curve applies equally to either a port or starboard roll. The initial curve holds true only for the initial stability of the ship which is determined by the original displacement and the specified distribution of the cargo, fuel, potable water, and other necessary items carried onboard a vessel. Any time a new condition exists such as when the ship sustains damage during battle or during collision or possibly runs aground, a new curve must be made to define the changed stability condition.

An important factor involved with the stability of a ship and which is a factor in the plotting of the stability curve is the draft of a ship which directly effects the righting moments. A change of draft will cause a change in the center of gravity, metacentric height and will also result in altered righting moments throughout the range of stability. This becomes critical under damage conditions and is also an important factor when loading a cargo vessel.

Another important factor when considering the stability of a vessel and the stress capability of the structure is the trim of the vessel. Trim is the difference between the drafts at the bow and stern of the vessel. Thus, when the ship trims, it inclines or tilts about an axis through the geometric center of the waterline plane which is known as the center of floatation. This trim directly effects the longitudinal stability of the ship. If a ship is out of trim by a small amount, this is not of concern, but if any large trim variations occur, this can directly effect the overall longitudinal stability of the ship. Excessive or critical trim can cause the ship to plunge or sink by diving under the surface of the water.

Trim also effects the "hog" and "sag" of the ship. These terms apply primarily to extremely elongated vessels such as super tankers and refers to the characteristic wherein the ship is bowed up in its midsection which is referred to as "hogging" or where it bows downward which is called "sagging". This tendency to hog or sag can induce extreme stresses in the hull girder structure of the vessel with an extreme condition causing actual shearing and breakup of the hull with subsequent sinking.

The damage and flooding of compartments in a vessel also presents other major concerns. If a watertight compartment has been breached allowing water to enter the compartment but not completely filling the compartment, a condition called "loose water" will exist in the compartment which can add other forces and disturbances. In addition, if the opening in the compartment is open to the sea which allows free passage of water in and out, this also adds additional forces and disturbing factors. These two factors are called the effect of "free surface" and "free communication". Both of these factors will greatly affect the righting moment and righting arm which directly effects the stability of a vessel.

As can be readily seen from the above discussion, the normal stability of an oceangoing vessel is inherently designed into the original configuration of the vessel. Even in operation with its full compliment of personnel, cargo and load, stability is inherently maintained within the design parameters and boundaries with a safe condition existing. Adversity, however, can radically change this situation to a point where the ship is no longer safe and in danger of plunging, capsizing and sinking. This is the distressed operational condition to which a substantial part of the present invention is directed.

This catastrophic change in the stability of an oceangoing vessel can be an accepted possibility in a military or naval ship. By the same token, with a commercial vessel, it is possible that catastrophic adversity such as collision, running aground or storm at sea can produce the unsafe condition. The question which arises is what can be or should be done when this unsafe condition exists.

The two primary ways of correcting this unsafe or unstable condition is to either flood counterbalancing compartments in the vessel or to dewater or pump out water which may abnormally exist in one or more of the compartments. This action is intended to produce counterbalancing forces in the vessel which will return the vessel to a normal stable condition. When this occurs, the unsafe condition is negated.

In the past it has been common practice to guess at what countermeasures are required to return the ship to a reasonable safe condition. Using this approach has in many cases resulted in catastrophic loss and sinking of the vessel. It is very easy to counterflood a wrong compartment which would tend to overbalance in the opposite direction, causing the entire vessel to roll and to capsize. By the same token, it is possible that counterflooding of a compartment either fore or aft of the center of floatation could over exaggerate an already dangerous trim condition which could cause the ship to plunge or break-up. Thus, it is possible that a "hit or miss" approach to this situation can prove to be even more dangerous than if no corrective action is taken.

In order to eliminate the guesswork that occurs in many cases there has been an attempt in the past, both on military and commercial vessels to manually calculate the stability status of the vessel under different conditions. This is naturally a very time consuming process when considering the number of watertight compartments or tanks which are present below the waterline or damage control deck of a ship. The structural size of each compartment as well as the location of the compartment with respect to the vertical, horizontal and longitudinal axis of the vessel must be accurately determined. This is a difficult task even under normal stable conditions due to the fact that the actual loading of the individual compartments during normal operations is constantly changing or varying. It becomes almost impossible under catastrophic conditions which exist at a time of damage or collision. Under these conditions, the status of various compartments is rapidly changed by flooding or the shifting of weight which if rapid enough or of a great enough magnitude can place the vessel in extreme danger in a short period of time.

In the past, the original stability condition of a vessel was obtained by the "inclining" method. This was an attempt to physically measure and calculate the actual center of gravity and hence the stability righting moments which would be developed at various angles of heel and trim. This information was acceptable for normal operation of the vessel but is of limited value in time of change due to damage or emergency.

Improvements in these primitive methods took the form of more precise measuring and calculating of the dimensions and stability moment parameters for the compartments and tanks onboard a vessel. However, these parameters were seldom corrected or updated for various day to day changes or even if the ship underwent major alterations or modifications. The result being that usually all of the available stability information was quickly out of date and unreliable. Even with this questionable background, the real problem begins when the ship sustains damage and flooding from either battle, collision or grounding. In most emergency situations, reaction time must be measured in minutes but because of the unreliable stability information and the antiquated methods used for obtaining information and calculating new parameters, it usually takes many hours to assess the situation and take the necessary corrective action. In many cases, this amount of time is not available with the needless loss of the vessel, as well as the possible loss of lives.

Attempts have been made to manually calculate a stability data card for every watertight compartment, tank or space in the vessel. These cards include current moment arm and moment force for each compartment based on various percentages of hypothetical flooding of the compartment. Thus, the projected moments and arms for each compartment based on increments of flooding, such as one-fourth, one-half, three-quarters or totally flooded are provided on the moment stability card. At the time that damage occurs, it is necessary to physically record the damage and extent of flooding for each effected compartment and transmit this information to the damage control operator.

From the previously calculated moment stability cards the necessary moments and arms for the individual damaged compartments are then obtained and the corresponding applicable information for that particular compartment is collected on a summary sheet. By reporting and summarizing this information, the total change in the stability of the vessel in its post-damaged condition can be determined. Thus, a crude indication is provided as to what possible corrective action may or may not be feasible to return the vessel to a stable condition.

In most cases, these calculations from the time that damage might occur until some corrective action for this damage can be analyzed and taken can require a number of hours. As can be easily understood in many cases where considerable damage is sustained this amount of time is not available and the ship can be sunk or the use of the vessel can be essentially lost before corrective action can take place.

In February 1982, the applicant installed and experimented with a computerized data base system onboard the aircraft carrier U.S.S. Midway. From the platform data base that was established for this vessel it was found that projected moment parameters for each compartment under various flooded conditions could be more rapidly obtained and printed as individual moment stability cards. It was agreed that this printed card could be quickly updated and later used in time of emergency to aid in manually analyzing the stability status of the vessel. The entire process could be accomplished in a relatively shorter time of an hour or less rather than the many hours which had been required in the past.

INFORMATION DISCLOSURE STATEMENT

The following patents are believed to be of importance when considering the subject matter of this invention. These patents are listed herein for the purpose of complying with the applicant's duty to disclose all known information pertinent to the prosecution of this application.

The patent to Fisher (U.S. Pat. No. 3,329,808) discloses a cargo loading analog computer for ships. Fischer states that the ship may be divided into ten sections, each of which is treated as an individual entity. A status board is disclosed having dial indications showing the load in tons for each compartment. Each dial is manually set by the load operator. In addition, the status board has a means for indicating draft, bending moment, vertical moment and c.g. height so that each section of the ship may be considered an entity and load forces occurring in a given section may be calculated.

The patent to DeWilde (U.S. Pat. No. 3,408,487) describes an analog computer for calculating the bending moment, shear force and trim at any one of a plurality of sections along the length of a ship. The calculations are performed by use of adjustable inputs, each of which corresponds to the loading input from a specific compartment or tank. From this information, the device provides an output indicating the bending moment and/or shear force at any one of a plurality of sections along the length of the ship.

The patent to Baldwin, et al. (U.S. Pat. No. 2,751,921) discloses an analog computer which is combined with transducers to automatically sense and control the center of gravity of a vehicle. Although this disclosure is directed primarily to aircraft, the same teaching applies also to ships. This system discloses the use of an analog computer having inputs from transducers positioned in compartments and fuel tanks within the vessel. Through moment summing circuits, the center of gravity of the craft is controlled by regulating the amount of fuel that is utilized from each fuel tank. This is an automatic device and provides ongoing stability for the vehicle.

The patent to Martin, et al. (U.S. Pat. No. 3,915,109) discloses a stabilization device for ships. The movement of fluid within a stabilization tank within the ship is compared with information relating to the actual roll of the ship. By the use of logic circuits, a determination is made whether adjustments are necessary in the fluid height within the tank to optimize the stabilization effect.

The patent to Russ (U.S. Pat. No. 3,847,348) discloses a ship mounted stabilizing roll tank which is instrumented to provide signals which indicate the actual tank moment. A computer type device is provided for automatically analyzing the necessary data and determining the tank moments.

The patent to Miyamoto, et al. (U.S. Pat. No. 3,916,809) is directed to a protective device for covering a gas buoyancy bag provided as part of a ship safety device. A folded gas bag can be secured to the side of a ship and arranged to be inflated by gas pressure to provide additional buoyancy to prevent the ship from being submerged or capsized. It is disclosed that this patent relates to preventing a ship from sinking due to damage or storm.

SUMMARY OF THE INVENTION

The present invention is an improved moment stability system which developed through experimentation from the beginning. A complete system is presented herein which eliminates the "cut and try" methods that have been utilized in the past. Now it is possible to obtain up-to-date stability information and curves concerning the vessel in a matter of minutes and at any time. In addition, it is possible to quickly modify and correct this information for damage sustained by the vessel and provide a competent corrective strategy for counteracting any unsafe, unstable condition.

Accordingly, it is the purpose and object of the present invention to provide a system which rapidly analyzes the situation and provides an accurate corrective action strategy which can stabilize and possibly save the ship in a relatively short period of time.

Throughout this application, the invention is referred to as the Computerized Moment Stability System (CMSS). The system is designed for actual installation and use onboard the seagoing vessel.

The hardware used for performing the system as described herein can be any commercially available minicomputer or microcomputer which incorporates a suitable memory device having a large enough capacity and printing capability. The power supply provided for the hardware usually incorporates some arrangement whereby power interruption during an emergency can be negated. In order to perform properly onboard a ship, especially a Naval ship in time of warfare, it is necessary to ruggedize the equipment to better withstand the anticipated shipboard environment.

In actual operation, the entire shipboard hardware is mounted on a unitized, ruggedized, structural frame having the approximate size of an office desk which is arranged for ease of installation, operation and maintenance during use. Suitable software is provided for programming the hardware to perform its desired function and for the recordation of the data base information. Each system contains a completely separate platform data base which is unique to the specific vessel and will be compiled from all available information for that vessel. This information can include the actual construction drawings for the vessel as well as loading and umloading data and data obtained from day to day operation of the vessel.

The Computerized Moment Stability System provides automated and operator controlled functions for the determination of original and normal day to day stability parameters for the vessel. The normal operation stability parameters are updated periodically as necessitated by changes in the liquid and cargo loads and by other weight shifts, additions, or removals during operation. In addition, the system provides a liquid load inventory which enables the operator to obtain the current status of all liquids carried onboard such as fuel oil, boiler feed water, potable water and lube oil with a minimum of operator data input. In this way, absolute current stability information is at all times present in the system and ready in case that the vessel may sustain damage or be involved in a collision.

Upon sustaining any damage or upsetting circumstance which effects the stability of the ship, the system provides for the determination of the ship's actual stability conditions in the post-damage environment. The damage data can be either obtained manually or automatically to show the extent of the damage which has resulted in the flooding of interior spaces. Through this arrangement, the actual stability of the ship at any time can be quickly determined with suggested corrective action designated by the system or the system can project in advance what result any proposed operator corrective action will have on the ship.

Another important function of the Computerized Moment Stability System is to provide a plurality of stability data cards which can be generated, one for each watertight compartment or tank on the ship. Again, these stability data cards can be updated periodically to maintain current information. If for some reason the Computerized Moment Stability System becomes inoperable in a time of emergency, the stability data cards can be used as a backup in conjunction with a stability moment plotting board to manually determine the stability status of the vessel and provide a reasonable corrective action to save or protect the vessel. Even this manual backup capability is far superior to the computation methods presently used onboard most ships since the available information is current and reliable.

The present novel system incorporates four basic modules for executing the functions of the system. These modules are the operational stability module, the stability assessment module, the corrective strategy module and the data base module.

The data base module provides a functional data base capability for storing the original structural and stability data concerning the ship. This information creates a permanent platform data base which includes the compartment or tank designations and the dimensional parameters of the center of gravity of each compartment or tank and the dimensional data for each compartment or tank and the stability, displacement and other curves in a digitized format. This information is updated periodically for ship alterations. From this information, the stability data cards can be generated for each compartment.

The operational stability module is provided to update the system data base with current information concerning the status of various tanks, cargo compartments and weight changes throughout the ship. This information can be inputted manually by the operator or automatically depending upon the capabilities of the system which is provided. A current stability status data file is continuously maintained and the present stability condition of the vessel can be quickly determined by the printout of stability data and curves.

The stability assessment module provides the capability to determine and report post-damage stability data based upon changes in the operational stability of the vessel due to reported damage following battle action, collision or running aground. This information can be operator entered or automatically generated and inputted to the system by strategically located sensors and transducers.

The corrective strategy module provides a projected stability appraisal of the vessel and provides corrective action strategy and recommendations based on the post-damage stability condition. It is possible to input an operator corrective action strategy and to determine the effect this strategy will have on the stability condition of the vessel before actually taking this action.

Through these modules and the interaction of these modules with each other and the data base, a Computerized Moment Stability System is provided which will greatly increase the safety and survivability of an ocean-going vessel. Throughout this disclosure, it is to be understood that the analyses, assessments, and corrective action strategies performed by the system are accomplished by the use of calculations based on stability equations for vessels which are well known in the art. For example, these equations are shown and discussed in *Introduction to Naval Architecture* by T. C. Gillmer and Bruce Johnson, Naval Institute Press, 1982; and *Naval Ships' Technical Manual,* NAVSEA S9086-CN-STM-010, Chapter 079 "Damage Control Stability and Buoyancy", 1976. The use of these equations in conjunction with the present system produces the new and novel results described and claimed herein.

The foregoing and additional features and advantages of the present invention will become more readily apparent from the following detailed description.

BRIEF DESCRIPTION OF THE DRAWINGS

FIG. 10 is an example of a stability data card which is generated by the data base module;

FIG. 17 is a pictorial presentation of the final system generated corrective strategy analysis report.

DETAILED DESCRIPTION OF THE INVENTION

Figure 1:
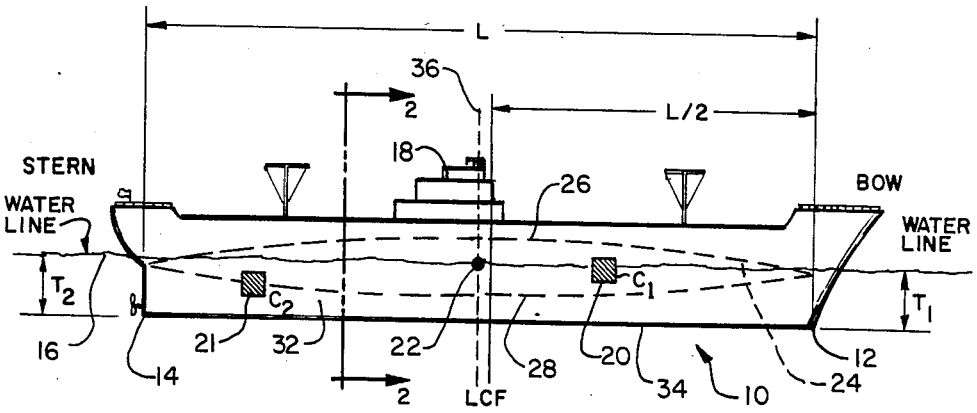
FIG. 1 is a pictorial side view of a vessel showing the parameters of importance in the present Computerized Moment Stability System.

Turning now more specifically to the drawings, FIG. 1 shows an outline of the side view of a ship or vessel 10 having a bow 12 and a stern 14. The waterline 16 is shown approximately midway in height along the side of the ship. The point where the waterline intersects the approximate midpoint of the ship is called the center of floatation 22. The keel 34 is the bottom most portion of the ship's hull 32. $T_1$ is the draft of the vessel at the bow. $T_2$ by the same token is the draft or depth of the vessel at the stern. Trim is the difference between $T_1$ and $T_2$. Slight bow or stern trim can be tolerated with ease in most oceangoing vessels. However, if this trim becomes excessive for any reason, it can cause the ship to become unstable longitudinally causing it to sink by plunging either at the bow or stern.

Figure 2A:
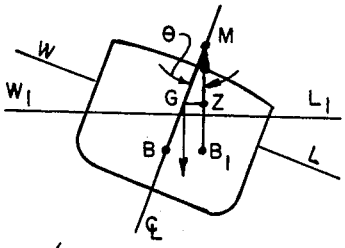
FIG. 2A is a pictorial sketch of the vesssel in a heeled position showing the righting moment arm GZ.
Figure 2:
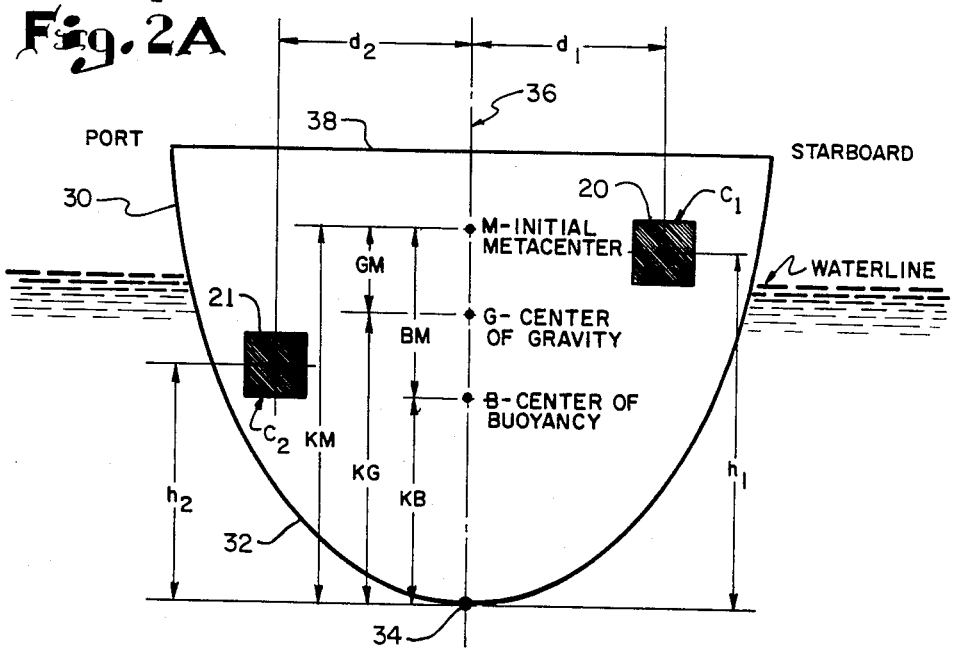
FIG. 2 is a pictorial cross-sectional view of the vessel taken along the lines 2—2 of FIG. 1.

In generally the same way, transverse stability is illustrated in FIG. 2. The hull 32 and deck 38 are shown with keel 34 provided at the midpoint of the lowermost section of the hull 32. The outer skin of the vessel's hull 32 including the deck 38 forms the hull girder 30. The hull girder 30 is essentially a hollow box beam and the ship's structure essentially follows the stress patterns and characteristics for this type of beam. A vertical longitudinal plane 36 divides the ship in equal halves designated as starboard on the right and port on the left when looking forward. The center of gravity G, which is illustrated as being hypothetically located on the vertical plane 36, is the point through which the entire weight of the vessel is said to act vertically downward. Due to the hull configuration the center of buoyancy B is shown on the vertical plane usually below the center of gravity and is located at the hypothetical point at which the buoyancy of the water acts vertically upward on the hull 32 of the ship 10. The metacenter M is the hypothetical point of intersection of two successive lines of action of the force of buoyancy when the hull is heeled or tilted to some angle. It is usually well known that the height of the metacenter with respect to the center of gravity (GM) represents a measure of the ship's stability and its ability to return to normal upright position after receiving a disturbing force.

For the purposes of the illustration presented in this application, the dimension KB represents the height of the center of buoyancy above the keel of the vessel. In turn, the height of the metacenter, above the center of buoyancy, is represented by the dimension BM. The dimension KG is the height of the center of gravity above the keel with the dimension GM representing the height of the metacenter from the center of gravity. By the same token, the dimension KM is the actual height of the metacenter above the keel. The length of these dimensions with respect to each other determine the maximum righting arm GZ generated as the ship heels which represents the stability condition of the vessel. FIG. 2A shows the vessel in a heeled condition represented by the angle 0. As the vessel heels, the center of buoyancy B shifts off center $B_1$. The metacenter M is represented as the point where the buoyancy force acting vertically intersects the centerline of the vessel. The horizontal distance between the buoyancy force $B_1$ and the center of gravity G illustrates the righting moment arm GZ.

Also for the purpose of illustration, typical compartments or tanks $C_1$ and $C_2$ are illustrated within the hull of the vessel, both in the cross section, FIG. 1, as well as the side view, FIG. 2. As can be seen $C_1$ is shown forward of the center of flotation 22 while $C_2$ is shown aft of the center of flotation. $C_1$ has a height $h_1$ above the keel of the vessel and has a dimension $d_1$ which is to the right or starboard of the vertical plane 36. The compartment $C_2$, on the other hand is represented as having a height $h_2$ above the keel and a dimension of $d_2$ to the left or port side of the vertical plane 36.

There can be any number of watertight compartments or tanks onboard the vessel. Each of these compartments has the structural dimension of length, width and height to define its internal volume as well as its physical dimensions to represent the projected center of gravity under various increments of flooding for that compartment above the keel of the vessel as well as either side of the vertical plane. The dimensions of each compartment and its physical position within the vessel as well as the weight of the contents of the compartment or tank establishes the permanent data base used in the stability system according to the present invention.

The data is either obtained manually or automatically. The construction drawings for the specific vessel can be used to obtain the dimensions of the compartments or tanks and the dimensions of the relative position of these compartments within the hull of the ship. In addition, the construction drawings can also be used to generally determine the weight of the cargo or liquids stored in the subject compartment by performing the calculation of this weight from the known density of the material. The necessary dimensions and other permanent data base information is obtained for every compartment and tank throughout the entire ship. The damage control deck 24 is the highest continuous deck of the vessel. This deck and the area below it include those compartments or tanks which are of most consequence if damage occurs which allows these compartments to either partially or completely flood and effect the stability of the overall vessel.

Figure 3:
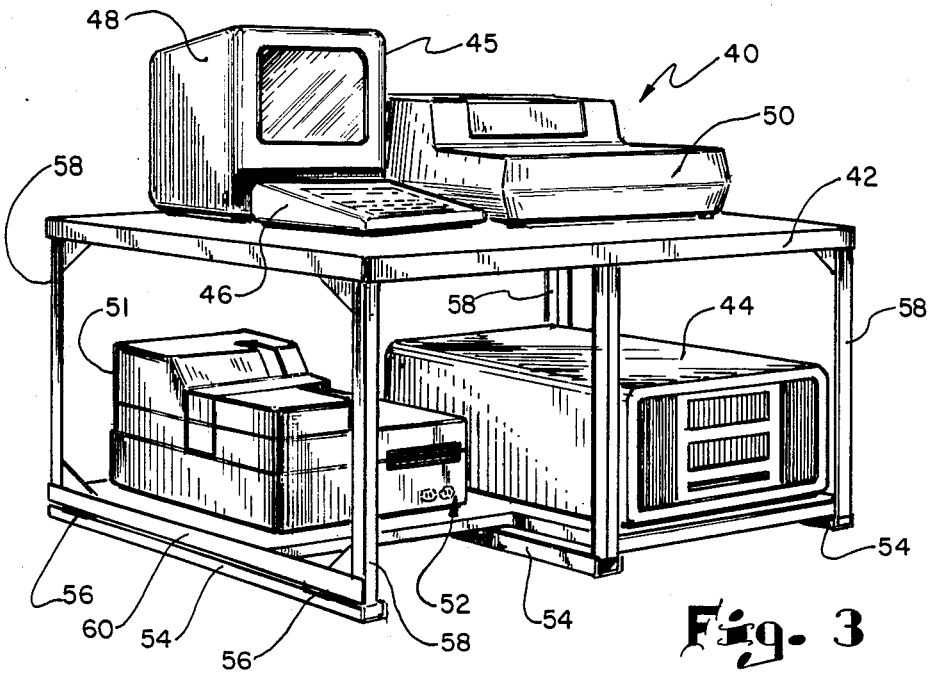
FIG. 3 is a perspective view of typical hardware which can be utilized for performing the system according to the present invention.

The hardware unit 40 for implementing this system can be relatively inexpensive and noncomplex. FIG. 3 shows a typical installation having a support structure 42, minicomputer 44, data input terminal 45 which includes keyboard 46 and cathode ray tube (CRT) monitor 48, and printer 50. The support structure 42 includes the vertical support legs 58 which are mounted to cross members 60. The cross members are mounted on shock mounts 56 which connect to the anchor channels 54 which are installed securely to the deck of the ship's compartment. In this way, the equipment which is relatively delicate is isolated from the vibration and shock which can be transmitted through the structure of the ship or vessel.

An uninterruptible power supply 51 and filter or conditioner 52 is mounted in the lower section of unit 40 and provides a battery powered auxilliary power supply if the normal power supply from the ship's electrical distribution system is interrupted for any reason. The incoming electrical power is filtered by the power conditioner 52 which is used to isolate the computer components from electrical pulses or interference which can be transmitted through the ship's electrical system. In this way, a relatively constant voltage is provided to the computer and the other integral working accessories.

Although it is understood that different types of computer hardware and accessory equipment can be utilized to perform this system, a Wang Laboratories Model 2200SVP-16B minicomputer has been found to be quite satisfactory. This computer has a capacity of 64K bytes of usable memory and employs an MSI central processing unit (CPU) which executes the built-in Basic II incremental compiler, operating system, operational programs and system diagnostics. A Winchester drive having an eight inch hard disk is incorporated which has a capacity of two megabytes of RAM storage. This memory device is contained within a sealed housing which eliminates the environmental problems that can be encountered in shipboard operations. In addition to the hard disk drive, a single floppy disk memory drive is also incorporated. The floppy disk can be a dual sided double-density diskette drive that can store approximately one megabyte of data. Both of these storage devices are mounted within the computer main housing.

A Wang interactive terminal Model 2236DW is used with the microcomputer designated above. This terminal 45 includes the keyboard 46 and the CRT monitor 48. The monitor is a 12 inch diagonal display which utilizes a full 128 numeral-character set. Graphics, especially box graphics, are used for drawing horizontal or vertical lines on the screen which enables forms to be depicted and printed through the system.

The CRT display has a 24 line, 80 character-per-line capacity. The cursor movement and positioning is controlled from the keyboard 46 while a number of special function keys are utilized for special formatted displays.

A dot matrix line printer 50, such as the Wang Laboratories Model 2235, is used with the designated computer. This printer has a $9\times9$ dot matrix format to print a full ASCII set of 96 characters, producing a 132 character line. The printer is fully capable of reproducing any display that is presented on the monitor.

Any suitable power conditioner 52 can be utilized with this hardware. A Topaz Model 70301 has been found to be quite satisfactory. With this power conditioner input voltage can be as high as 13% above nominal or as low as 25% below nominal and still be conditioned to within plus 6% or minus 8% of nominal, respectively. All of this is accomplished within one cycle of power.

The other power unit is an uninterruptible power supply (UPS) 51, such as the Topaz Model 80384. This device contains a rechargeable "GEL" battery which automatically supplies the computer system when power is lost. Because of the nature of the computer used in this system, a maximum power loss duration of 33 milliseconds is tolerated without loss of function or memory. The UPS unit selected for this system automatically senses loss of power and transfers to battery operation in four milliseconds typically, with 10 milliseconds being maximum. In turn, this unit is capable of maintaining 400 volt-amperes for a 20 minute minimum period. Through actual use and experimentation, it has been found that the total equipment provided herein for the hardware unit 40, even during continuous printout, requires approximately 370 volt-amperes. Thus, during maximum operation, it is anticipated that the power supply provides sufficient power to allow the hardware to remain functional to provide the necessary stability analysis and corrective action during catastrophic situations even when no external power can be provided from the ship's distribution system. In addition, the UPS automatically transfers to the system internal power when the shipboard voltage drops below 102 volts AC, thereby providing low voltage protection as well as power interruption protection. The restoration of the external shipboard power automatically transfers the system back to the ship's electrical power when the external voltage reaches a voltage of at least 109 volts AC.

The hardware unit 40 is provided as a complete operational package with all equipment mounted and electrically interconnected and functional. The hardware unit is installed or removed from its shipboard location in a minimal amount of time. In this way, it is possible to replace the complete unit without the necessity of troubleshooting the hardware onboard the ship and removing or repairing individual components.

Figure 4:
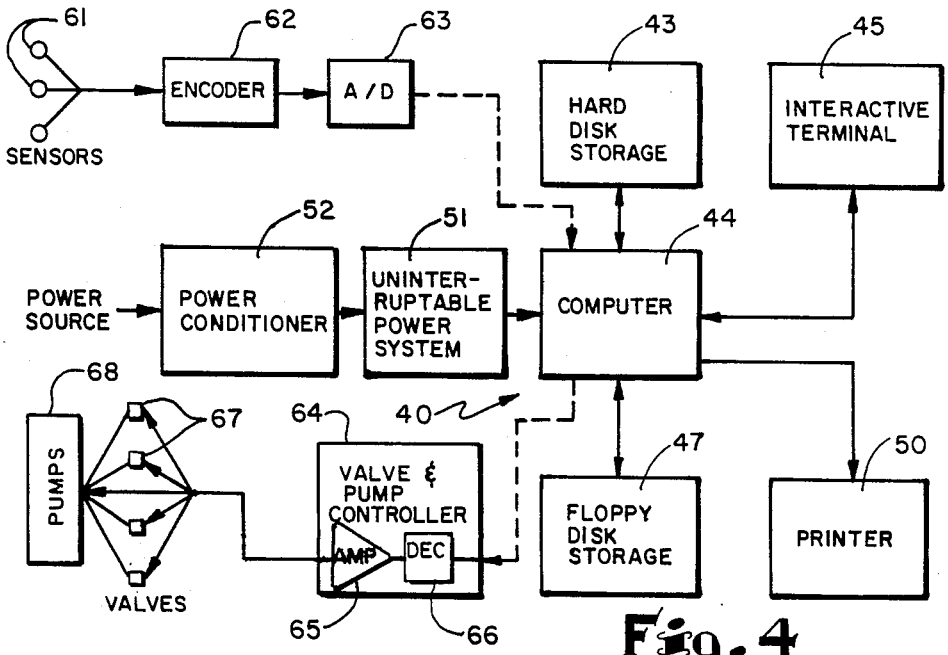
FIG. 4 is a block diagram showing the interconnection of the system hardware.

As can be seen in FIG. 4, a hardware block diagram is provided wherein the electrical power source is introduced on the left side through the power conditioner 52 and in turn the uninterruptible power system 51. A hard disk, Winchester type memory drive 43 and floppy disk memory drive 47 is connected to the computer 44. These two devices provide input of the system program and storage for the data base utilized throughout the moment stability system. An interactive terminal 45 comprising the manual input keyboard and CRT monitor display is connected to the computer 44. In addition an output printer 50 is also provided for printing the displayed information.

Automatic fluid level detection is accomplished by flooding sensors 61 located in each watertight boundary, compartment or tank. Sensor activation is identified by encoder 62 and the level signal is analyzed by A/D connector 63 and sent to computer 44. Computer output to dewater or flood a specified compartment or tank is sent to valve and pump controller 64 which through amplifier 65 and decoder 66 energizes the addressed valve 67 in the selected compartment or tank and/or pump 68.

The Improved Moment Stability System which is provided herein essentially contains four major functions. These four functions cover the areas of (1) data base initialization and maintenance, (2) operational stability analysis, (3) stability assessment and (4) corrective strategy analysis. With these four capabilities, the precise necessary corrective action can be made to arrest any unstable condition which might exist and to return the vessel to a safe, possibly operational status.

As most people are aware, a seagoing ship or vessel is made up of a number of decks extending transversely across the entire width of the vessel and extending for its full length. The highest continuous deck is usually designated the "damage control deck". Usually from this deck downward to the keel of the vessel, the decks are divided into various watertight compartments, tanks or passageways which make up the volume of the vessel below the waterline. The purpose of making these areas watertight is to prevent complete uncontrolled flooding of the vessel so as to maintain and control stability and to prevent or delay sinking.

In addition, the main deck, side plating, keel and bottom plating of the vessel all contribute to form what is called the "hull girder" structure. This type of structure essentially follows the same stress patterns that are usually found in a square type hollow girder or beam that is commonly used in construction. As can be easily understood, the safety of a vessel is not only based on the stability of the hull but also the stress capabilities of the hull. The vessel, experiences considerable external forces at the time of damage or abnormal situations which not only can account for the capsizing of the vessel but also the breakup of the hull into several sections with possible subsequent sinking of some or all of the sections. The system according to the invention addresses both of these situations and protects the vessel against subsequent damage or loss.

There is a procedure which is performed on large vessels called an "Inclining Experiment" which through the shifting of known weights and mathematical techniques can adequately determine the position of the ship's center of gravity (G). This inclining experiment is utilized to update and verify the calculated center of gravity and stability curves which have been mathematically or graphically determined.

When the ship sustains damaging forces, especially below the waterline, it is easily understood that the existing operational stability of the ship can be either moderately or greatly effected by the damage. In prior damage situations it has been mandatory that personnel physically check the status of each affected compartment or tank to accurately determine the extent of the damage and the amount of flooding that has taken place.

As previously described there is anticipated three types of damage to which the vessel can be subjected. These are battle damage, collision damage and grounding. Although the present stability system can be applied to grounding situations and used in the ungrounding of the vessel, it is primarily intended for damage that is sustained during battle or collision.

In order to adequately initiate the present system, it is necessary to obtain physical data and dimensions for the overall structure of the entire ship as previously discussed. This information as well as the operational information concerning the contents and percent of utilized capacity of the various storage areas is used as input data to develop the unique platform data base which is obtained under the present system.

After the data base is established for the specific vessel, this information is continually updated as the data changes. This update can be performed automatically by the use of various types of sensors and transducers which can be mounted in each compartment or tank onboard the vessel, especially those areas on the damage control deck and below. In this way, the data or information can be continually fed into the system data base or into a central receiving unit which can manually or automatically record the information for each compartment.

It should be emphasized that the collected data can be manually or automatically fed into the computer data base which is part of the present system. This data can be reported automatically and directly to the computer and stability system, or collected and stored periodically by a separate data collection unit or device or physically collected and reported by personnel. The data in the separate collection unit is tied to the computer through a separate system or program or inputted manually to the present stability system. The intent of all of these methods is to provide the most up-to-date data available to the system.

The following is a brief overview of the system and its modules. This discussion is intended to set the stage for a more detailed description of each module and its function which is presented later.

Figure 5:
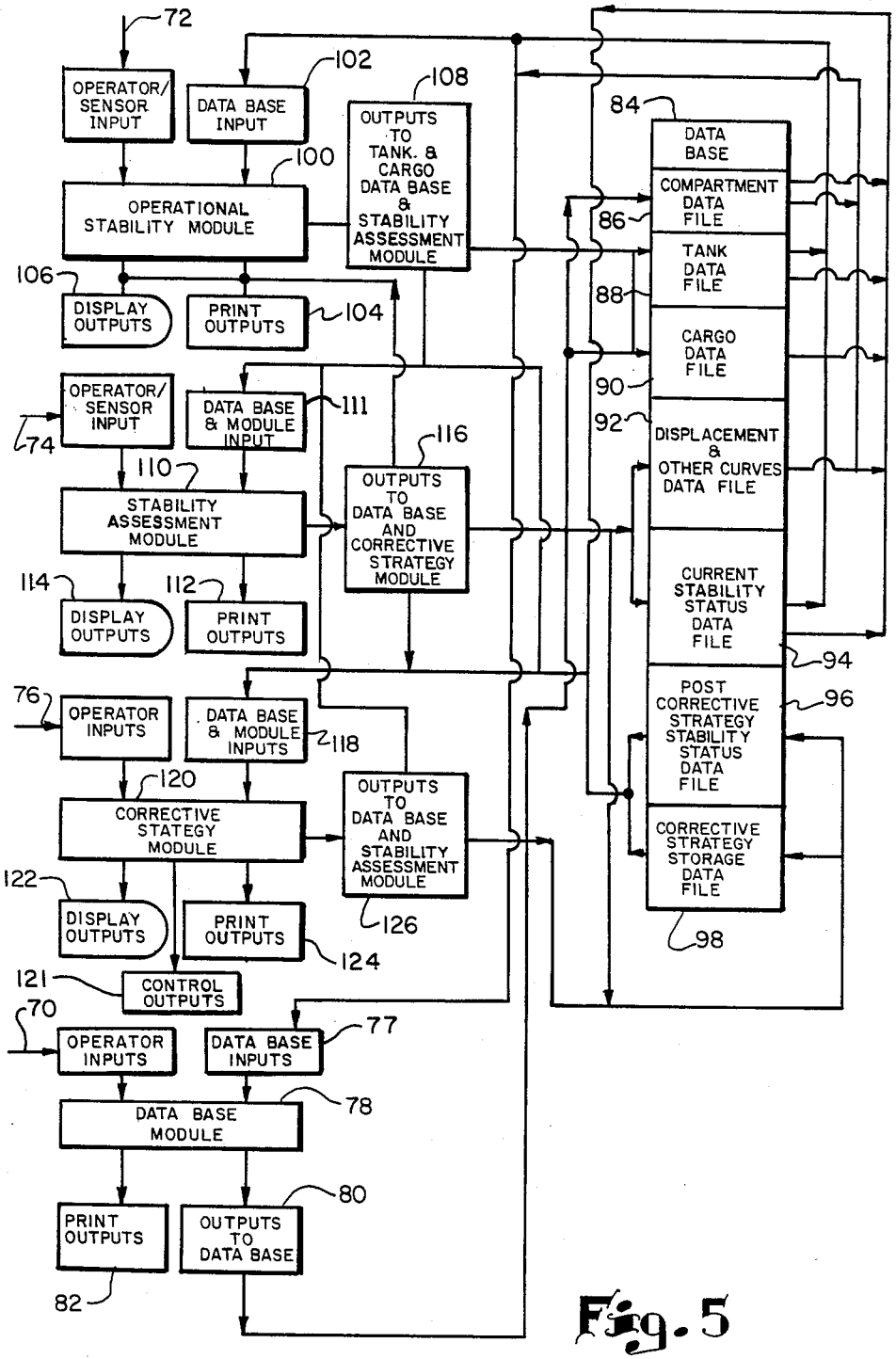
FIG. 5 is a block diagram showing the overall operation of the complete system.

The data base module 78, FIG. 5, is utilized to initiate and provide a reference for the system. This is accomplished by inputting the data which as been accumulated either physically or through the data measuring and sensing devices as described above. These dimensions and all other pertinent information concerning each of the compartments and the other physical attributes of the vessel are input directly through the terminal keyboard by the operator 70. This information is processed by the data base module 78 which outputs the data through the output 80 to be recorded in the hard disk memory of the previously described hardware. The data base module 78 can also output the data through the printer output 82 so that a hardcopy printout of the data can also be obtained if desired. Thus, the information input which consists of the dimensional elements of each compartment and tank as well as the cargo status of various compartments onboard the vessel and displacement and other curves are stored as part of the data base 84.

The data base 84, as can be seen in FIG. 5, is divided into various files such as the compartment data file 86, tank data file 88, cargo data file 90, displacement and other curves data file 92, current stability status data file 94, post-corrective strategy stability status data file 96 and corrective strategy storage data file 98. The various files as defined herein are merely locations in the memory in which that specific type of information is stored.

The entire platform data base 84 which is provided in the system is of necessity unique to the specific vessel for which the system is intended. The system is generally standardized for the specific type of intended vessel or use, such as oceangoing ships, super tankers, oil well drilling platforms, or any other type of vessel. Thus, the basic system for each type of vessel is generally compatible except for the data base which applies only to the individual, specific vessel.

An additional function of the data base module 78 is to maintain the platform unique permanent data base. This function is not intended for use during normal operations but merely to correct errors in the data base or to modify the data base to reflect the result of ship alterations or a new inclining experiment for the vessel. This feature is the only function which can be used to modify the permanent data base. Other operations can access and update, but not significantly modify, this original permanent data base.

The operational stability module 100 provides the capability to enter correction data to be added to the permanent data base to reflect current stability status and to generate administrative and stability reports reflecting current status. Various operational reports and administrative reports can be provided from this module to update and document the day to day housekeeping functions of the vessel concerning its staple cargo components. Data base input 102 from the permanent data base 84 can be provided as well as operator/-sensor input 72 concerning the current condition data for the ship. The module has an output 104 for driving a printer and an output 106 for display of information directly on the CRT monitor. The processed output concerning tank and cargo data base and the information to be transmitted to the stability assessment module is provided through output 108 where it is split to the respective data base and module.

The operational stability module compares the newly entered data with the latest "as inclined" data from the permanent data base. The differences between the entered and permanent data is used to calculate and update the following three moments; (a) vertical moment (VM), (b) trim moment (TM) and (c) inclining moment (IM) for each tank, compartment, or cargo/weight location in which a change has taken place, such as use of fuel oil, consumption of ammunition or loading or unloading of cargo.

The operational stability module 100 after performing its function outputs the completed updated information and data back to the tank data file 88 and cargo data file 90. At the same time this output is fed directly into the stability assessment module 110 for further processing.

The stability assessment module 110 performs a number of functions relying on data from many sources. Direct input of data from the operational stability module as well as the corrective strategy module described later is fed directly to this module. In addition, data from the data base 84 including the compartment data file 86, tank data file 88 and current stability status 94 is accessed by this section. In addition, operator input 74 provides the post-damage data which is obtained from either personal observations or automatically by such means as automatic information sensors 61. In turn, this section provides a printout as well as CRT monitor display of the results of the processing of the data. The output 116 from this section is split and fed to the corrective strategy module 120 as well as being stored in the displacement data file 92 and current stability files 94 of the data base.

The output of module 116 is directed to the data input 118 for the corrective strategy module 120. The input 118 can be supplemented by input 76 concerning the overall structural integrity of the vessel. The functional control of this section can be performed by either of three methods. The first method is an automatic corrective strategy analysis which is performed on the data input that is provided. This machine suggested corrective action strategy is outputted either to control output 121 directly to the valve and pump controls 64 or to the printer output 124 or is visually displayed on the monitor through the output 122. At the same time a separate output returns the strategy information to the post corrective stability file 96 and corrective strategy file 98 which is part of the data base 84. The second method is to input proposed corrective action strategy for correcting any stability problems which may exist with the vessel. The module 120 can process this input to predict the effect that this suggested strategy would have on the overall stability of the vessel. The third is a combination of the machine generated strategy modified by an operator's entries. Thus, three strategy methods either system, operator suggested or the combination can be processed by the system with a printout or display of the corrective action and what the projected results will be on the overall stability and safety of the vessel.

The data base 84 is constantly enhanced and corrected with new and up-to-date data concerning the latest stability status of the vessel and necessary corrective action, if any, that should be taken. From this data base additional operations can be performed once the corrective action has been taken. In this way the final stability status of the vessel can be determined to verify that all necessary action has been completed or that additional corrective action should be made to further improve the status of the vessel. This function may not only be necessary for retaining the safety of the vessel but may also be capable of returning the vessel to operational status in a time of battle.

Figure 6:
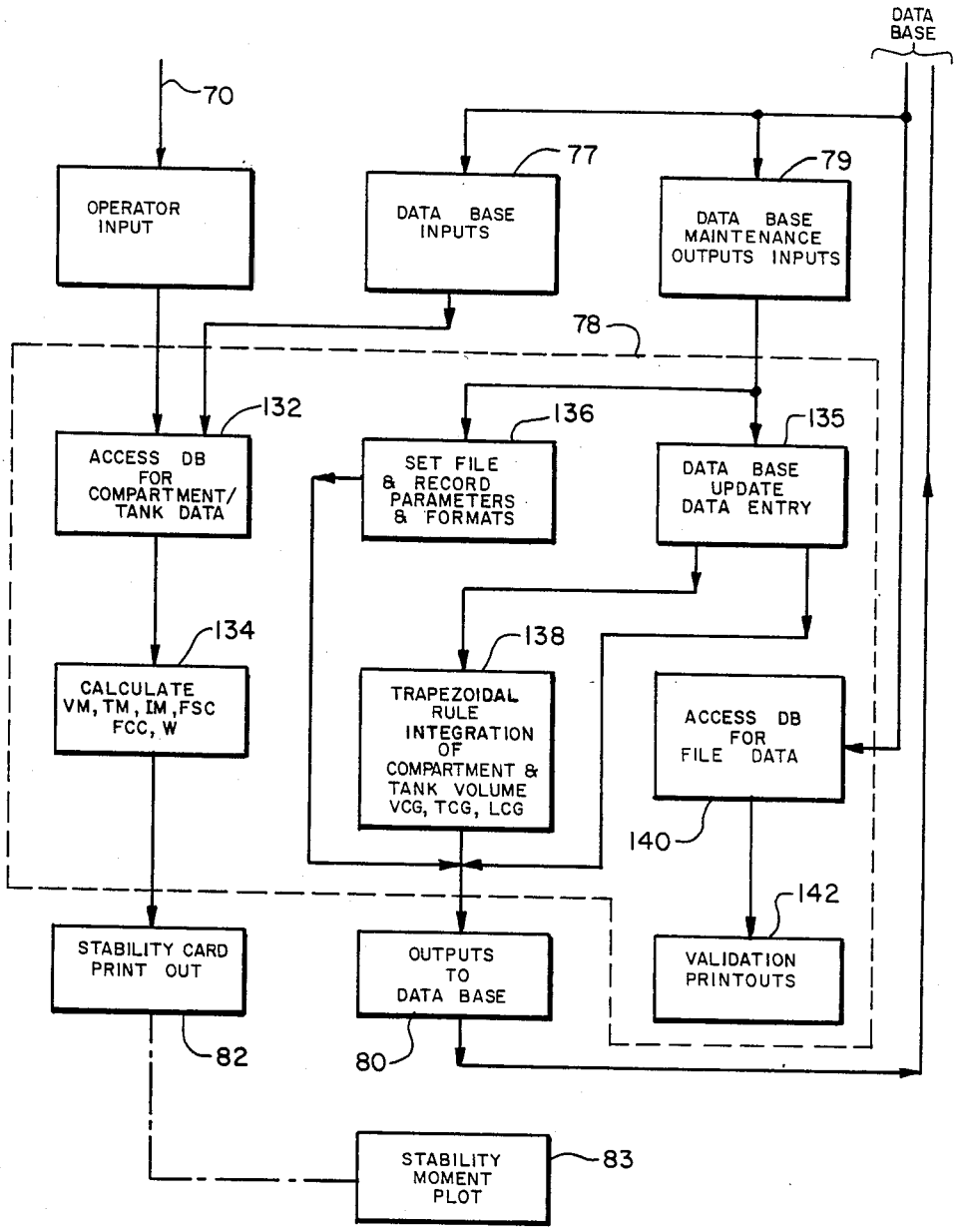
FIG. 6 shows a block diagram for the data base module.

As now shown in more detail in FIG. 6, the data base module as previously described essentially performs a very basic function. Through this module, the operator inputs through the system terminal sufficient data to establish a permanent data base file. The permanent platform data base incorporates the original information and dimensions necessary for every watertight compartment and tank onboard the vessel.

After the initial data base has been established the printing of a set of stability data cards is accomplished by accessing the data base 132 through the data base input 77. The stored information is recalled and processed to determine the vertical moment (VM), trim moment (TM), inclining moment (IM), free surface factor (FS), free communication factor (FC) and weight added (WA) at 134. Each one of these elements is calculated for various increments of flooding within the compartment or tank. Thus, the weight and moments for each item for each ten percent increment or other increment of flooding within the tank is provided.

An example of a stability data card 81 generated in this way is shown in FIG. 10. The identifying number for the individual tank or compartment is shown at the top of the card. Below this is the accepted name of the compartment or tank with the identification of the six parameters along the left margin. For the inclining moment and trim moment, a suffix is added which indicates whether the moment is to the starboard (S), port (P) or center (C) of the vessel while the trim is designated forward (F), aft (A) or center (C). Along the right margin of the card the units for the individual calculations are given. In the body of the card 81 is given the actual calculated moments and weight for each increment of flooding of the compartment ranging from a minimum of 10% to a maximum flooded condition of 100%. All of these items are of importance in determining the overall stability of the vessel based on the individual condition of each compartment.

As previously explained, the printed stability moment data cards which can be generated by this process are stored as hard copy for later use. The applicable stability cards for all damaged compartments and tanks are then retrieved and the corresponding moments and weight for the applicable condition of flooding for the respective compartment or tank is recorded. This information is compiled on what is called a stability moment plot 83 from which the actual stability conditions for the vessel at that particular moment can be mathematically and manually determined. As previously stated, this step is only intended to be used as a backup for the complete system which is described herein since it takes considerable time to perform the manual function. It is to be noted that the data base module does not directly interface with any other module in this system except for the data base storage.

As an adjunct to the data base module, the data base maintenance operator input 79 is inputted from the data base and is split between a data base update entry 135 and the file and record parameters 136. In the file and records parameter 136, data files are created and formatted and sent directly to the output for return to the data base 80. In performing data base maintenance functions, data is entered via the data base update input 135 and is processed by trapezoidal integration 138 to determine the compartment and tank volumes weight and the vertical, trim and longitudinal center of gravity for the individual compartment or tank. These results are returned to the output 80 for transmission to the permanent data base for storage. In addition, this module also allows the data base to be accessed through station 140 whereby a validation printout for the data that is presently stored in the data base can be printed through output 142 to verify accuracy and completeness of all of the data base information that is in the system.

The operational stability module 100 which forms an important part of the overall system provides the capability to enter correction data to be applied to the permanent data base. These corrections are utilized to reflect current stability status and to generate administrative and stability reports reflecting current status of the vessel.

This module provides three major functions, namely operational stability status update, display and printout of current operational stability reports, and display and printout of engineering and administrative reports for operational and inventory control of the vessel.

The overall intent of this module is to update tank and cargo weight data to reflect the current operational status of each. This data is stored in the modifiable portions of the appropriate data base files such as the tank data file 88 and cargo data file 90. When the update is complete current stability reports are printed for the day-to-day status.

Figure 7:
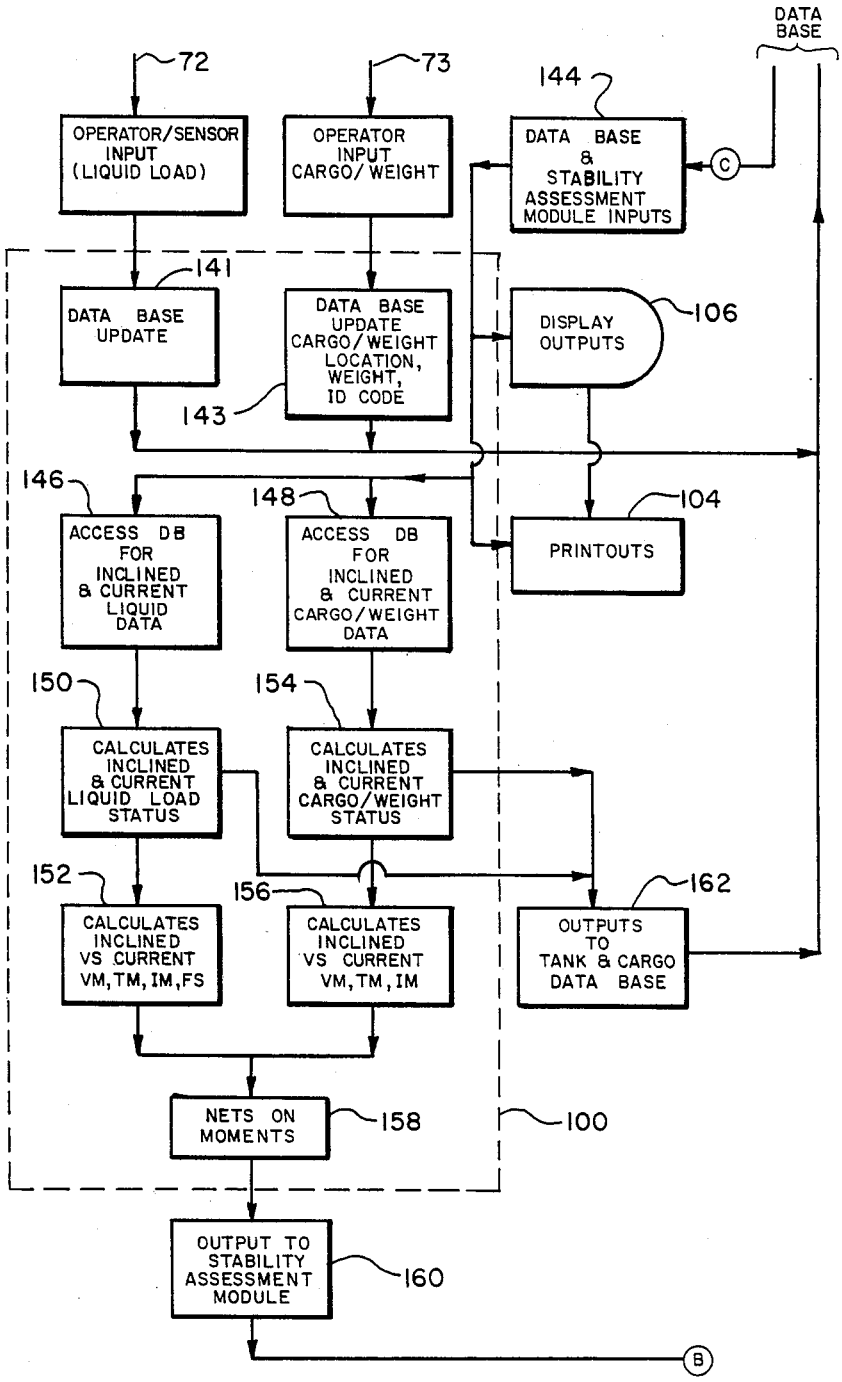
FIG. 7 shows a block diagram for the operational stability module.

Input 72, FIG. 7, provides the information concerning the liquid loads and input 73 provides the information concerning the cargo/weight status. The liquid load input 72 is provided through the terminal keyboard or sensors and provides the individual tank identification number as well as the type and density code for the contents and liquid height of those contents. At the same time the cargo/weight change input includes the location of the cargo or other weight and center of gravity which is determined by the distance above the keel, the distance forward and aft of the midperpendicular of the vessel and the distance starboard and port of the centerline of the vessel. In addition, the weight of the cargo as well as the identification code for that cargo such as ammunition, food, etc. is provided. This information is transmitted and stored in the applicable file section of the data base. From there it is drawn back into and inputted through the data base input 144 for further use in the module. The information at the modular input 144 which is output from the stability assessment module 110 can be either displayed through the monitor output 106 or printed through the output 104. By the same token, data from the data base can be transmitted to the liquid level, data station 146 or the cargo/weight data station 148. Through processing the liquid level status, the data base information for the original "inclined" status of the vessel as well as the current information for liquid in the various tanks is processed through station 150 where comparisons are made to upgrade the center of gravity and its location for each tank. This information is transmitted to the tank and cargo data base output 162 while at the same time, further calculations are performed in station 152 to determine the revised moments for the effected tanks.

In the same way, the data base information concerning the original "inclined" status for cargo and other weight and the current cargo/weight data within the respective compartments is fed directly into station 154 where a comparison is made between the original status and the current status for the respective compartments to upgrade the center of gravity information. This information is sent directly to the output to be returned to the cargo/weight 90 files of the data base 84 while further calculations are performed at 156 to determine the actual updated moments for the cargo/weight location where cargo/weight status has been changed. The combined moment changes which have been updated in this module are then combined at 158 to provide an upgraded total moment status for the present condition of the vessel. This information is then outputted at 160 directly to the stability assessment module 110 for further processing.

One of the necessary functions of the operational stability module 100 is to support the daily reporting requirements for the operation of the ship. The ship's engineering department as well as the command section can be provided with quick access to current ship cargo and support material data. This portion with its composite printouts can be utilized to provide updated and current cargo reports and inventory reports for the vessel at any time. In addition, through the stability assessment module which will be described later, the system can provide desirable loading and unloading procedures for receiving or discharging cargo from the vessel while maintaining the best stability status.

As an adjunct to this function, the inventory reports allow the commander of the vessel to control inventory and provide judicial use of necessary fuel, fluids and staple supplies needed in the day to day operation of the vessel. In this way, the liquid load inventory reports can be utilized to fill out the daily consumption reports which are required onboard most vessels.

Figure 8:
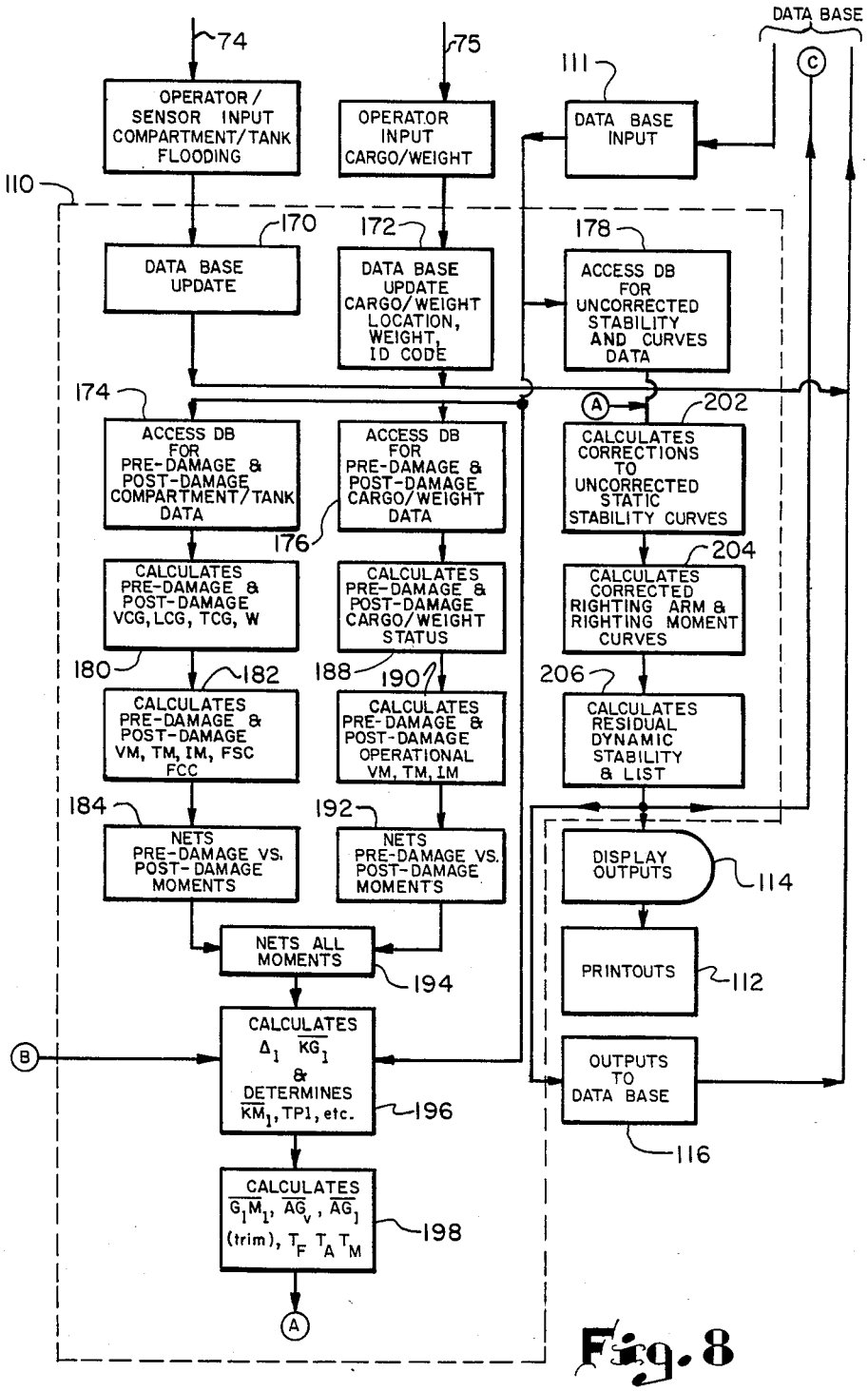
FIG. 8 shows a block diagram for the stability assessment module.

The stability assessment module 110, FIG. 8, provides the most important function of the present stability system. This module provides the capability to determine and report current stability status based upon routine and normal changes or reported damage following a collision or battle action. In addition, projected stability data based upon the operator provided or system generated corrective action strategies can be developed. In accordance with this, the functions provided by this module are operational stability assessment, post damage stability assessment and corrective strategy stability assessment.

The stability assessment module 110 is intended to support the operational stability module 100 by determining the current operational stability status based upon entered changes in liquid and cargo load as well as other weight shifts, additions or removals. The results of the processing of the data is returned to the operational stability module for report generation and storage in the current data base. When initiated by the operational stability module, the stability assessment module function shall receive the various moment data for each tank and cargo location and perform a comparison with the permanent data base information. The differences are summed algebraically and various stability factors are revised and returned to the operational stability module for processing. The stability factors are further corrected for free surface and free communication effects which are added to the elements calculated. This information as well as the revised stability factors are stored in the current stability status data file 94.

The post-damage stability function shall provide the capability of analyzing and reporting the post-damage stability status following a collision or battle action based upon data entered using the reports received from repair and damage control personnel or sensor input. If the system generated stability assessment does not approximate actual conditions, i.e. significant variance appears to exist between the reported list, trim or draft of the vessel and the actual conditions, the damage control personnel are alerted to the fact that the damage reports are incomplete or inaccurate.

The third phase of this module incorporates the stability assessment function described below. The stability assessment is provided by calculating and providing projected stability data based upon the suggested or provided corrective action strategy. This function is designed for use after the post-damage stability function has been exercised and has generated stability status approximating actual conditions. From the information that is transmitted from the stability assessment module to the operational module, stability reports can be generated and either printed or displayed on the monitor.

As can be seen in FIG. 8 the stability assessment module 110 has data inputs 74 and 75 pertaining to compartment or tank flooding and cargo and weight status. This information is in turn transmitted to the data base for storage. The revised data base information is reacquired and reenters the module at the data base input 111. The input 111 is divided into four areas 174, 176, 178 and 196 for data access for predamage and post damage compartment status, for cargo and weight status, displacement and other curves, and for subsequent corrective action strategy assessment.

The predamage and post damage data is first processed for center of gravity locations and this information in turn is used to calculate the various righting moments and coefficient factors for free communication and free surface. This information is algebraically summarized for later use. At the same time, the data base information for the cargo and various weight changes or cargo shifts are transmitted from 176 to 188 for the calculation of predamage and post-damage status and moments. This information is then fed to the summation step 194 where the net predamage and post-damage information concerning the applicable moments for the respective compartments and tanks as well as the cargo and weight are provided. This data is used to calculate the final stability parameters for the vessel in its latest condition. Some of these determinations include the change in the height of the center of gravity for the vessel as well as the height of the metacenter and the actual trim of the vessel.

The data base access portion 178 provides information concerning the original stability curves for the vessel. This information is passed to 202 where it is combined with the calculations from 198 concerning the present stability data for the vessel. This information is combined to apply necessary corrections to the existing static stability curves. This data is then transmitted to 204 where the calculations are made for the corrected righting arm and righting moment curves for the vessel. These curves are run periodically during normal operations and immediately after damage has been sustained by the vessel. The set of post-damage curves show the actual stability situation for the vessel in the damaged condition. The corrected curve information is processed in 206 whereby further calculations concerning the residual dynamic stability and the actual list for the vessel is determined. The output of 206 is split with the information going through the output 116 directly to the data base with the output also being processed through the display 114 as well as the printer output 112 for the printing of the information if desired. This data output is also simultaneously returned to the data base input 144 of the operational stability module.

From this discussion, it can be seen that the stability assessment module is the most important of the three basic modules. The stability assessment module is not primarily intended for providing printouts for display of the actual information but performs the necessary processing of data from both the operational stability module as well as the corrective strategy module. Information is interfaced between all of these modules with the primary operational steps performed in the stability assessment module.

Figure 9:
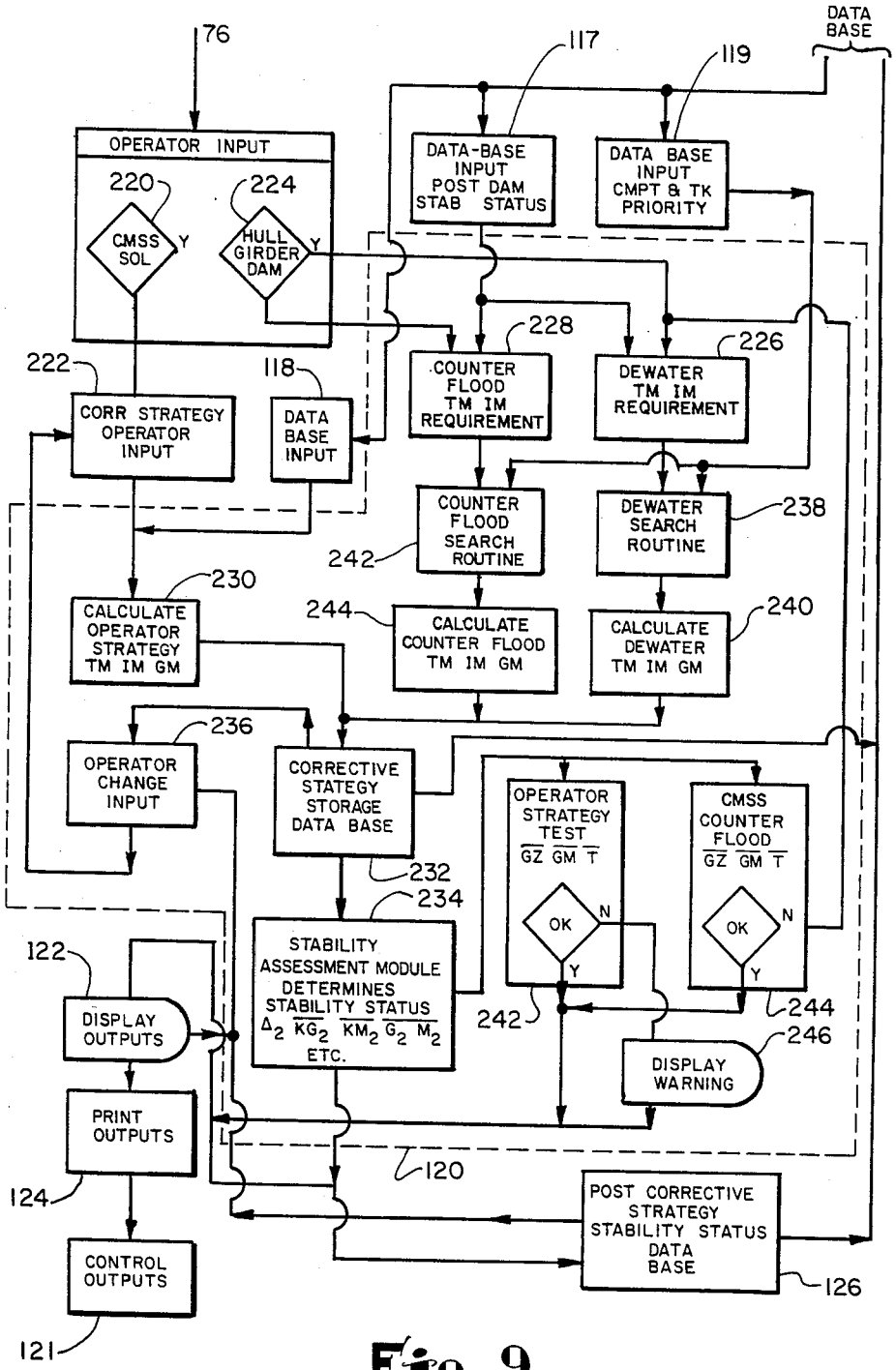
FIG. 9 shows a block diagram for the corrective strategy module.

The corrective strategy module 120 is shown within the dotted lines in FIG. 9. The corrective strategy module 120 provides support to the damage control personnel after post-damage stability has been properly assessed. Once this information is considered to be correct the corrective strategy module 120 provides the capability to obtain anticipated stability data based upon corrective action strategies which can be either entered by the operator or generated within the system. The processing of this data accomplishes the following functions: (a) assess operator entered corrective strategy; or (b) determine system generated corrective strategy. In operation, the data base input 117, 118, and 119 provides the stored data and information to the module. At the beginning the operator through input 76 is questioned as to whether the system is to provide the corrective strategy input. If the answer is "no" the process progresses directly to the operator input strategy 222. If the answer is "yes" the system inquires as to whether there is "hull girder" damage. An affirmative response bypasses the process to the dewater strategy routine 226. A negative answer to the "hull girder" damage question directs the process to the counterflood procedure 228.

Returning to the operator input corrective strategy, the output from 222 and the data base from 118 is combined at 230 whereby the projected moments as determined by the proposed corrective action is completed. This information is then passed on to the corrective strategy storage data base 232. The other phase of the corrective strategy module where the system generates the corrective action is processed either through the dewater section 226 or the counterflood section 228. In the dewater section the final trim and inclining moment requirements are determined which are then combined with the compartment and tank priority data from data base 119. A search is then completed at 238 whereby a comparison is made to determine which flooded compartments can be dewatered to place the projected moments in proper prospective. Once a selection has been made the actual moments resulting from the dewatering are calculated in advance. This information is submitted to the corrective strategy storage data base.

If no hull damage has been encountered, the counterflooding procedure is then utilized whereby the trim and inclining moment requirements in the proposed corrective strategy are calculated. This information is obtained from the post damage stability data base where information from this data base and the tank and compartment priority data base are compared to determine which compartments and tanks can be successfully flooded as a counterbalancing measure. Once the search routing has been completed in 242 and the calculations for the selected counterflood program have been performed in 244, this information is transmitted to the corrective strategy storage data base. This data is at the same time transmitted to the stability assessment module 234 for a determination of the resulting final stability parameters. These values are sent to the control outputs 121, the display output for monitor 122 and the printer output 124 while at the same time they are sent to the post corrective strategy stability status data base for storage and later processing.

The projected results of the post corrective strategy is inputted back into the module whereby the results of the suggested corrective strategy is revised or changed as necessary. In this way, a feedback is provided whereby the suggested strategy can be revised and improved to provide the best results possible. In addition, the stability assessment module calculations after corrective action status has been completed are processed in the strategy test logic 242 and system counterflood test logic 244. The strategy tests are made to compare the metacentric height, trim and maximum righting arm positions to determine whether they are acceptable or not. If the results are acceptable, this results is provided at the monitor display and printout. If on the other hand the strategy is unacceptable a warning display 246 is transmitted to the display monitor 122 and the printer output 124. The moment stability system counterflooding check 244 also is verified through logic as to whether the test results fall into a predetermined required range. If the result is affirmative, the result is displayed. Otherwise, if the test is negative, this response is returned to the dewater input step where the corrective dewatering regiment replaces the counterflood solution to place the resulting parameters within the predetermined range. Once this situation has been corrected to a yes response in 244 the information is identified and displayed as being proper. The post corrective strategy stability status data is returned to the permanent data base where this information is reprocessed in the stability assessment module to update the projected list and trim analysis report, projected righting arm curves and righting moment curves for the corrective strategy and the corrective strategy analysis display.

The corrective strategy module in the system generated corrective strategy function can also determine which compartments and tanks should be flooded or dewatered and/or which cargo should be jetisoned to bring the ship's stability status as close to a reasonably safe condition as possible. If significant hull girder damage has been indicated, dewatering to relieve stress is used in the strategy. The stability assessment module is used to provide projected stability data again corrected for free surface and free communication effects. The projected stability data is stored in the post corrective strategy stability status data file. The operator may override and delete a compartment or tank from the strategy and have the corrective strategy module generate a revised strategy. This process can be continued until the operator has determined that an acceptable strategy has been generated. The operator can make the final decision as to the completeness of proposed strategy and implement the corrective action.

Figure 11:
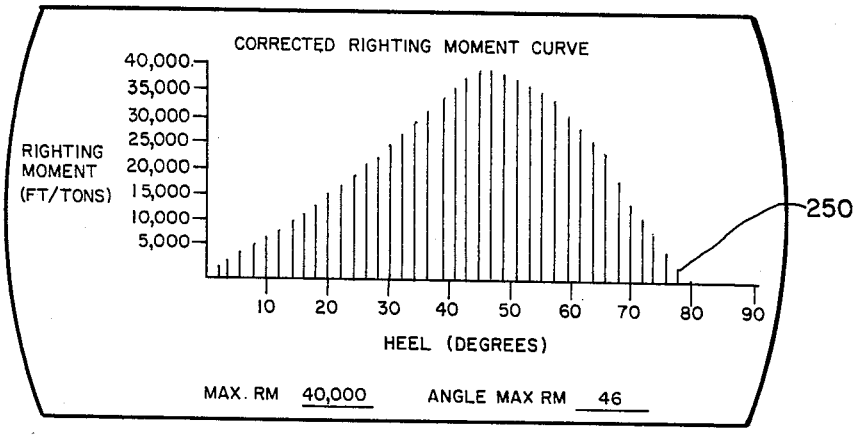
FIG. 11 shows a pictorial presentation of a typical corrected righting moment curve generated by the system.
Figure 12:
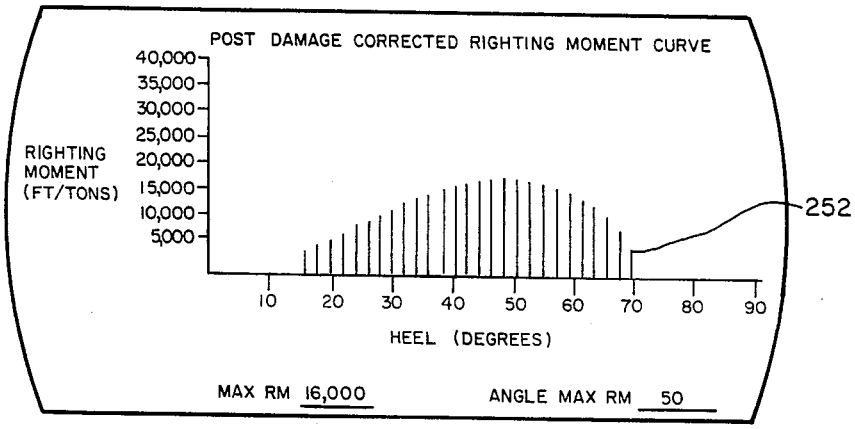
FIG. 12 shows a pictorial presentation of a typical post-damage righting moment curve.
Figure 13:
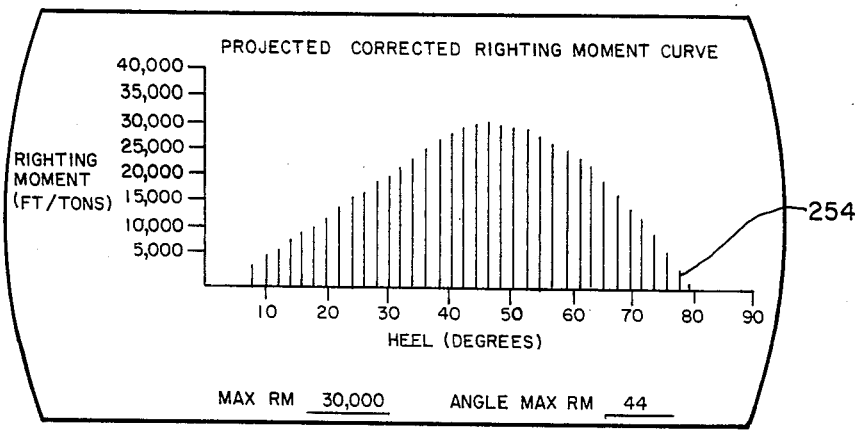
FIG. 13 shows a pictorial presentation of a righting moment curve after the corrective strategy has been accomplished.
Figure 14:
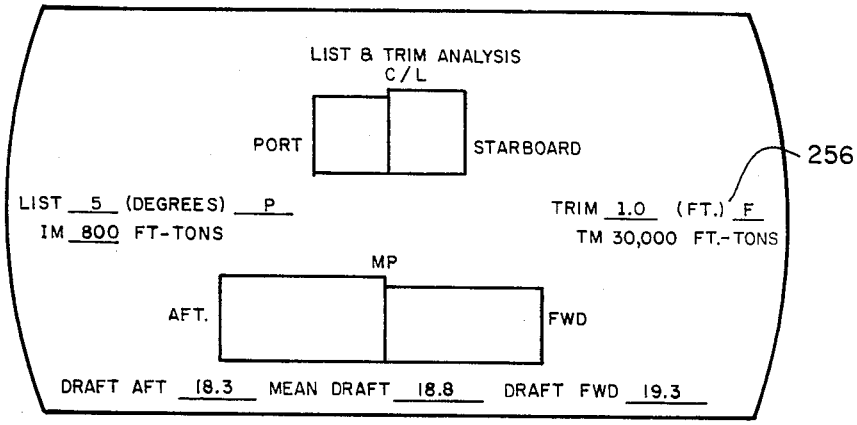
FIG. 14 is a pictorial presentation showing a typical operational list and trim bar graph analysis for the vessel.
Figure 15:
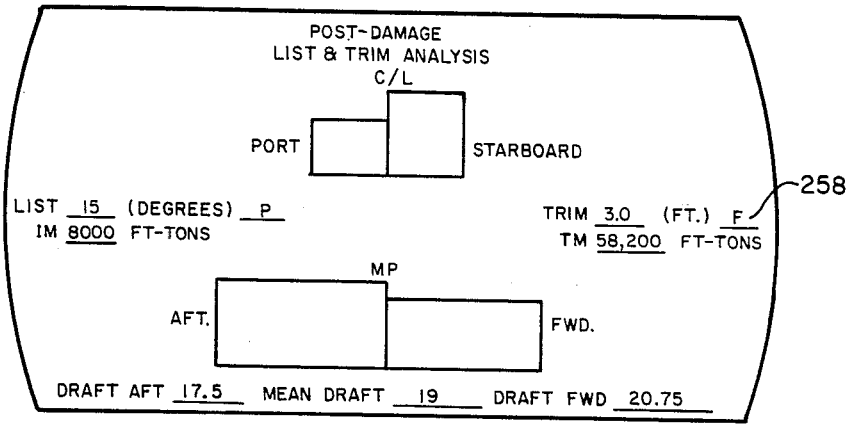
FIG. 15 is a pictorial presentation showing a typical post-damage list and trim analysis report.
Figure 16:
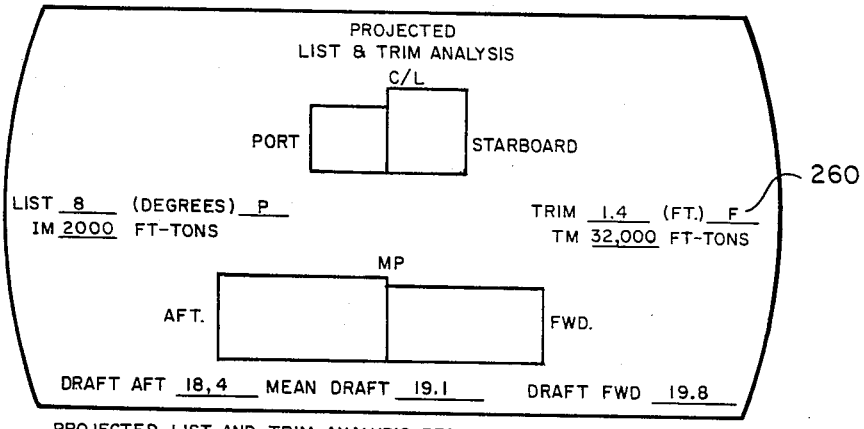
FIG. 16 is a pictorial presentation of the projected list and trim analysis report after the corrective strategy has been accomplished.

FIGS. 11, 12 and 13 show a sample of the typical righting moment curves which are established during the processing phases of the operational stability module, the stability assessment module and the corrective strategy module, respectively. FIGS. 14, 15 and 16 show a sample of the display reports for list and trim analysis which are provided as comparable steps in the system. Thus, the corrected righting moment curve 250 in FIG. 11 and the list and trim analysis report 256 in FIG. 14 are provided to report the operational stability of the vessel under normal operating conditions.

After damage of some nature has been sustained by the vessel and the information has been properly analyzed the righting moment curve 252, FIG. 12, is generated as well as the post damage list and trim analysis report 258, FIG. 15. As can be seen in the righting moment curve, the righting moment force of only 16,000 foot tons is generated at an angle or heel of 50 degrees. At this angle, the righting moment is considerably less than the moment provided in the normal operation condition where as much as 40,000 foot tons is available with a maximum heel angle of 46 degrees. The righting moment for the vessel is considerably less because of the damage sustained. By the same token, FIG. 15 shows that in the damaged condition, the list is 15 degrees to port while the trim is three feet forward. This means that the bow of the vessel is three feet lower than the stern. At the same time it is shown that the draft at the stern or aft portion of the vessel is 17.5 feet while the bow is 20.5 feet. This results in a mean draft of 19 feet which is greater than the 18.8 feet which is the mean draft for the vessel under normal conditions. FIG. 13 shows the projected righting moment curve 254 for the vessel after the decided corrective action has been accomplished. As can be seen, the righting moment has been restored to approximately 30,000 foot tons at a heel angle of 44 degrees. By the same token as shown in the list and trim report 260, the list has been decreased to eight degrees port with the mean draft at 19.1 feet.

The projected results for the suggested corrective action are shown in the CRT display 262 represented FIG. 17. This displayed report 262 identifies the post-damage stability parameters at the top portion of the report. The system suggested corrective strategy is displayed in the lower half of the report wherein three compartments have been designated for counterflooding. The inclining moment, trim moment, and offset GM and GZ changes are shown as the result of the corrective action. At the bottom of the report is shown the projected effects that this strategy will have on the overall stability of the vessel. The accomplishment of this strategy is anticipated to result in the righting moment curve 254 and the projected list and trim analysis report 260 which were shown previously in FIGS. 13 and 16. It should be noted that the operator can obtain a hard copy printout of all CRT displays which are shown in FIGS. 11 through 17.

Throughout this discussion, reference has been made to the moment stability system according to the present invention being capable of being computerized and operated through this medium. A suitable program can be written to adapt the system for use with any type of computer hardware. It is to be understood that the invention is directed to the system itself and not specifically limited to any specific operational procedure.

Another important aspect that should be considered is the fact that this invention can also be used on any floating body which is supported in a liquid medium. Thus, the system lends itself to any type of vessel having a number of compartments which can be utilized for maintaining stability and buoyancy. This consideration is in addition to the common ordinary oceangoing ships either military or civilian. Included in the civilian classification would be the industrial type vessels such as oil or gas drilling ships or platforms. These vessels have various compartments built into the structure for ballasting and maintaining proper stability. The system described herein lends itself readily to this type of vessel and can maintain the proper stability during the actual drilling operation.

An improved moment stability system for vessels has been shown and described in detail. It is to be understood that this invention is not to be limited to the exact form disclosed, and that changes in detail and construction may be made in the invention without departing from the spirit thereof.

What is claimed is:

1. A moment stability system for maintaining proper stability for a large vessel after sustaining damage or abnormal conditions wherein the system includes in combination:

(a) a data input means which establishes a data base for the storage and retention of required information concerning the vessel for performing and maintaining the system;

(b) an operational stability means for utilizing the information in the data base to establish the normal operational stability parameters for the oceangoing vessel;

(c) a stability assessment means capable of receiving data concerning damage sustained by said vessel and determining the post-damage stability status of said vessel; and (d) a corrective strategy means which will compare the parameters of the operational stability status and the post-damage stability status and produce a suggested corrective action strategy which will return the vessel to a suitable stability status to provide a safe operating condition.

2. A moment stability system as defined in claim 1 wherein the data base means also includes a means for producing a series of moment parameters for each compartment and tank of said vessel, each set of parameters being established for various increments of flooding possible for said compartment.

3. A moment stability system as defined in claim 2 wherein the set of the parameters for the increments of flooding for each compartment and tank are produced in printed form whereby the printed set for all compartments and tanks onboard the vessel is stored for possible later use as a back-up to the system if a severe damaged condition should exist for said vessel.

4. A moment stability system as defined in claim 1 wherein said operational stability means provides means for producing reports defining the current operational stability parameters for said vessel.

5. A moment stability system as defined in claim 1 wherein said operational stability means includes a means for accumulating information concerning the consumables onboard said vessel and preparing an inventory report showing the status of the consumables on a day-to-day basis.

6. A moment stability system as defined in claim 1 wherein said operational stability means further includes means for producing stability curves showing the normal stability operational parameters for said vessel including all cargo, usable fluids and consumables onboard said vessel.

7. A moment stability system as defined in claim 1 wherein the operational stability means includes a means for determining the stability of said vessel so as to retain the stability parameters for said vessel within normal operating limits at all times.

8. A moment stability system as defined in claim 1 wherein the data base generating means includes a means whereby the data base can be continuously updated and corrected from data generated by said operational stability means and said stability assessment means, as well as the external input of data concerning any structural changes and operational and damage status of said vessel.

9. A moment stability system as defined in claim 1 wherein said corrective strategy means can accept an operator generated corrective strategy or can internally analyze and produce the necessary correction strategy for maintaining the operational stability of said vessel.

10. A moment stability system as defined in claim 1 wherein the corrective strategy means includes a means for inputting damage information concerning the vessel's hull girder structure and determining whether a dewatering or counterflooding corrective action procedure should be performed depending upon the girder damage input data.

11. A moment stability system as defined in claim 1 wherein the corrective strategy means further includes a means for visually displaying and printing the selected corrective action strategy whereby this action can be modified and revised to correct and improve the projected stability condition of the vessel.

12. A method of performing stability analysis and damage control onboard a large vessel, including the steps of:

(a) obtaining necessary data for the compartments, tanks and cargo location of said vessel;
(b) inputting said data into a data storage base whereby the data can be quickly retrieved as necessary;
(c) determining the normal operational stability of the vessel by use of the obtained data to determine the original stability parameters for the vessel;
(d) inputting updated data concerning the applicable compartments, tanks and cargo when a damaging force is sustained by said vessel;
(e) determining revised stability parameters for said vessel in said post-damaged condition;
(f) comparing the original stability parameters with the post-damage stability parameters and determining whether the revised parameters are within a predetermined safe range for the vessel; and
(g) establishing a corrective action strategy for improving the post-damage stability status of the vessel, if the parameters are outside the safe range, for returning the vessel to a safe and stable operational condition.

13. A method for performing a moment stability analysis as defined in claim 12 which further includes the updating of the data retained in the data base with information concerning the variable commodities carried onboard said vessel so that the operational stability of the vessel can be continuously updated.

14. A method for performing a stability analysis as defined in claim 12 which further includes the step of generating periodically an updated report showing the inventory of the consumables on said vessel.

15. A method for performing a stability analysis as defined in claim 12 which further includes the step of updating the data base with information concerning the loading, unloading and status of the cargo carried by said vessel and periodically generating a cargo status report.

16. A method for performing a moment stability analysis as defined in claim 12 wherein the inputting step further includes the step of digitizing the existing reference stability curves for the vessel and including this data in the data storage base.

17. A method for performing an analysis as defined in claim 16 wherein the operational stability step further includes the step of generating a series of updated reference stability moment curves showing the operational stability status of the vessel.

18. A method for performing a stability analysis as defined in claim 12 wherein the corrective action strategy step further includes the step of predetermining the anticipated operational stability of the vessel based on the projected post-damage corrective action strategy so as to verify that the vessel will be returned to a safe and stable condition prior to taking the corrective action strategy.

19. A method for performing a moment stability analysis as defined in claim 12 wherein the corrective action strategy is proposed by an operator and the results of this proposed strategy is predetermined to verify the projected stability of the vessel prior to incorporating the corrective action strategy.

20. The method for performing a moment stability analysis as defined in claim 12 which includes the step of generating the corrective action strategy and comparing the projected stability of the vessel with the original parameters to determine that the new parameters will be within a safe range.

21. A computerized moment stability system for a large vessel to retain the operational stability of the vessel within a safe range, the computerized system comprising:
(a) a computer processing means having a memory means for receiving and storing data for later retrieval, said computer means having an input terminal for inputting the data to said computer means and a display monitor for displaying the results performed by said computer means for later retrieval of information;
(b) an electrical power supply means provided for powering said computer means, said power supply means further including a filtering means for filtering out any interference which may be present in the electrical power being supplied to said computer means to retain reliable operation and a backup means for providing secondary power to said computer if the power supply means is disconnected; and
(c) a program means for providing system operational instructions to said computer means for performing an operational stability analysis and determining a suggested corrective action strategy for maintaining the stability parameters of the vessel within a safe predetermined range.

22. A computerized moment stability system as defined in claim 21 wherein dimensional data is inputted into said memory means for each compartment or tank on said vessel whereby the computer can determine the overall operational stability parameters for the vessel at any time and compare these parameters with the predetermined range of parameters which are acceptable for safe operation of the particular vessel.

23. A computerized moment stability system as defined in claim 21 which further includes a printing means connected to said computer means whereby the results obtained from said computer means can be provided in printed form.

24. A computerized moment stability system as defined in claim 21 wherein the data in the memory means is updated periodically for all consumables present onboard said vessel whereby as the status of the consumables changes the computer means will produce an updated inventory report concerning the status of said consumables and the current stability status of the vessel.

25. A computerized moment stability system as defined in claim 21 wherein the data in the memory means is updated with the status of the cargo carried by said vessel whereby the operational stability of the vessel can be determined based on the cargo status to aid in the proper positioning of the cargo during loading, unloading, or jettisoning operations to retain the stability parameters of the vessel within a safe range.

26. A computerized moment stability system as defined in claim 21 which further includes an automatic sensing means provided in each compartment and tank for sensing the presence of flooding, the flooding information being inputted to the computer memory means whereby the computer means can readily determine the actual operational stability status of the vessel at any time and generate a projected corrective action strategy when a flooding condition is sustained by said vessel.

* * * * *